United States Patent [19]

Ernst et al.

[11] 4,183,657

[45] Jan. 15, 1980

[54] DYNAMIC REFERENCE FOR AN IMAGE QUALITY CONTROL SYSTEM

[75] Inventors: Larry M. Ernst; Steven D. Seigal; George W. Van Cleave, all of Boulder, Colo.

[73] Assignee: International Business Machines Corporation, Armonk, N.Y.

[21] Appl. No.: 894,955

[22] Filed: Apr. 10, 1978

[51] Int. Cl.[2] ..... G03G 15/00

[52] U.S. Cl. ..... 355/14 R; 430/30; 250/559; 356/448

[58] Field of Search ..... 355/3 R, 14, 77, 133; 118/7, 646; 427/10; 96/1 R; 356/448; 250/559

[56] References Cited

U.S. PATENT DOCUMENTS

| | | | |
|---|---|---|---|
| 2,956,487 | 10/1960 | Giaimo | 355/14 |
| 3,094,049 | 6/1963 | Snelling | 355/3 DD |
| 3,348,521 | 10/1967 | Hawk | 118/7 |
| 3,348,522 | 10/1967 | Donohue | 118/7 |
| 3,348,523 | 10/1967 | Davidson et al. | 118/7 |
| 3,354,802 | 11/1967 | Doucette et al. | 355/10 |
| 3,611,982 | 10/1971 | Coriale et al. | 118/4 |
| 3,640,615 | 2/1972 | Schaeffer | 355/8 |
| 3,647,293 | 3/1972 | Queener | 355/15 |
| 3,647,295 | 3/1972 | Dobouney | 355/38 |
| 3,700,323 | 10/1972 | Guyette et al. | 355/14 X |
| 3,719,165 | 3/1973 | Trachienberg et al. | 118/7 |
| 3,719,169 | 3/1973 | Cade et al. | 118/636 |
| 3,724,942 | 4/1973 | Gibson et al. | 355/3 |
| 3,778,146 | 12/1973 | Knapp | 355/3 |
| 3,780,299 | 12/1973 | Bock | 356/448 X |
| 3,783,818 | 1/1974 | Makino et al. | 118/4 |
| 3,801,196 | 4/1974 | Knapp et al. | 355/3 |
| 3,834,807 | 9/1974 | Fuller et al. | 355/3 R |
| 3,850,662 | 11/1974 | Jahn | 355/3 R X |
| 3,893,414 | 7/1975 | Hudson | 118/637 |
| 3,901,593 | 8/1975 | Kogiso et al. | 355/11 |
| 3,911,861 | 10/1975 | Griesmer | 118/7 |
| 3,911,865 | 10/1975 | Volkers | 118/637 |
| 3,914,045 | 10/1975 | Namiki et al. | 355/15 |
| 3,926,338 | 12/1975 | Reyner | 222/56 |
| 3,927,641 | 12/1975 | Handa | 118/637 |
| 3,928,764 | 12/1975 | Bock et al. | 250/272 |
| 4,026,643 | 5/1977 | Bergman | 355/14 X |
| 4,082,445 | 4/1978 | Steiner | 355/14 |

OTHER PUBLICATIONS

Smith, G. L., "Toner Concentration Control", IBM Technical Disclosure Bulletin, vol. 19, No. 11, Apr. 1977, pp. 4078 and 4079.

*Primary Examiner*—Fred L. Braun

*Attorney, Agent, or Firm*—Charles E. Rohrer

[57] ABSTRACT

A system for checking copy quality variables within the image area of an electrophotographic machine. During a test cycle, quality is checked by producing sample test areas within the photoconductor image area ordinarily used for producing copies. Reflectance measurements are made on the sample test areas and compared to a dynamically floating reference achieved by a reflectance measurement from a cleaned portion of the photoconductor within the image area. The testing circuit is balanced so that the same reflectance voltage should be generated whether the single reflectivity-sensing device is viewing a sample test area or a cleaned reference area. The system checks for quality variables such as toner concentration, image voltage and an abnormally low reflectance photoconductor and provides a partial check on its own fault-free condition during periods when it is not in use.

9 Claims, 6 Drawing Figures

DYNAMIC REFERENCE FOR AN IMAGE QUALITY CONTROL SYSTEM

This invention relates to a quality control system in an electrophotographic machine and more particularly to a system in which the reference voltage for quality control is allowed to change dynamically with machine conditions.

RELATED PATENT APPLICATIONS

U.S. patent application Ser. Nos. 894,954 and 894,957; filed Apr. 10, 1978, relate to various quality controls which may advantageously utilize the inventive circuit principles described herein. U.S. patent application Ser. No. 894,956 describes a test cycle which may be used to advantage with the inventive circuit principles described herein. All of these patent applications were filed on even date herewith.

BACKGROUND OF THE INVENTION

In document copier machines of the electrophotographic type charged latent images are produced on a photoreceptive material and then developed through the application of a developer mix. Where the photoreceptive material is separate from the copy paper itself, a transfer of the developed image to the copy paper takes place with subsequent fusing of the developed image to the paper. A common type of developer mix currently in use in such machines is comprised of a carrier material, such as a magnetic bead, coated with a colored powdery substance called toner. It is the toner which is attracted to the charged, latent image to develop that image and it is the toner which is then transferred from the latent image to the copy paper (where the copy paper is separate from the photoreceptive material). Finally it is the toner which is then fused to the copy paper to produce the finished copy.

It is apparent from the procedure outlined above that toner is a supply item which must be periodically replenished in the developer mix since the toner is carried out of the machine on the copy paper as a reproduced image. It is also apparent that the concentration of toner particles in the developer mix is significant to good development of the latent image since too light a toner concentration will result in too light a developed image and too heavy a toner concentration will result in too dark a developed image.

Other variables which seriously affect copy quality include the image voltage of the photoconductor and the bias voltage on the developer. Many other variables factor into these basic quantities, for example, the quality of the original, the cleanliness of the optical system, and the condition of the photoconductor.

For a quantity control system that would attempt to accurately control toner concentration, image voltage, and other quality rendering factors, the control system itself must be designed to be as free from inherent error as possible. Broadly, this invention seeks to attain that general object. The most pertinent prior art relating to this problem known to the inventor is in the area of toner concentration control. That art includes U.S. Pat. Nos. 2,956,487 and 3,348,522. U.S. Pat. No. 2,956,487 provides a toner concentration control system where the reflectivity of the image to be reproduced is used as a measure of toner density. This system appears subject to difficulty since reflectivity readings will change dependent upon the quality of the original. U.S. Pat. No. 3,348,522 discloses a toner concentration control scheme in which a special test image is developed outside the image area used for reproducing document copies. In this latter patent separate reflectivity-sensing devices are used to simultaneously sense light reflected from a single light source, one sensing device to establish a voltage indicative of clear photoconductor outside the image area and the other to establish a voltage indicative of the test area which, as noted above, is also outside the image area. U.S. Pat. No. 3,348,523 is essentially similar to U.S. Pat. No. 3,348,522.

U.S. Pat. No. 3,926,338 discloses a circuit for use in a toner concentration control scheme. In this patent thermally insensitive photodetectors must be used since the large amount of heat generated during machine operation affects the accuracy of toner concentration control readings. Similarly, this patent says that a stable amplifying circuit, stable referring to temperature stability, must be used in order to avoid destruction of the validity of the sensed signal.

A better way has been discovered and is claimed in U.S. patent application Ser. No. 894,956; named above. Instead of producing a test area on a part of the photoconductor remote from the image area, it has been discovered that it is superior to provide a test cycle and place the test area within the image area itself. In that manner, the advantages of using a developed image are combined with the advantages of using the very same photoconductor that is used for document reproduction. It was found that on short runs the test cycle could be made to correspond to a run-out cycle after the last copy had been produced. However, during long, multicopy runs, it may be necessary to skip an occasional copy in order to provide a test cycle. Test cycles may be kept relatively infrequent, once every 10 copies, for example, or even less frequent, since the use of the image rea as a test area produces significant advantages in accuracy. Some reasons for this include the fact that as photoconductor ages with use, there is a tendency for toner to build up on the image area; that the photoconductor surface characteristics change with use, thus affecting development; and that the photoconductor suffers electrostatic degradation with use. A result of these factors is that the image area itself becomes darkened as compared to the areas of the photoconductor which are not used for image impressions and the photoconductor does not charge as well as it does when fresh. When photoconductor charge is reduced, the voltage levels of a resultant latent image are changed as compared to new photoconductor. As a result, copies are produced which are too light. However, in the system described herein, where the toner concentration control test area or the image voltage test area are produced within the image area any results of toner filming, aging, use, etc., are present in the quality tests. Consequently, the absolute quantity of toner in the developer mix can be adjusted as the photoconductor changes and the value of the developer bias voltage can be changed to provide compensating factors for the effects of change. Such results are not possible unless the quality tests are taken within the image area. Even if the tests are taken within the image area, there is still no assurance that the results will be accurate unless the testing circuit is able to compare the resulting quantities to a meaningful reference and unless the quantities are devoid of circuit-induced non-linearities. This invention is directed toward a testing circuit, method and apparatus which does provide a meaningful reference and does produce a result which is relatively free of circuit-induced non-linearities, noise and changes in temperature.

The inventors herein have discovered that it is advantageous to view a cleaned, uncharged area of the photoconductor within the image area in order to provide a reference voltage. The prior art schemes outlined above used a reference voltage obtained from outside the image area and consequently not subject to the variables named above. Additionally, the inventors herein discovered that various elemental factors such as temperature as well as component non-linearities prevented accurate comparisons of reference voltage and sensed voltage unless the identical sensor is used for both measurements and unless it is excited to similar levels during both measurements. In this regard, the inventors herein discovered that the amount of light received for both sample and reference measurements by the sensor must be made equal (at the correct quality level) to avoid photodetector non-linearities and an ingenious circuit arrangement to provide this property was invented.

In the system described herein a reference voltage is allowed to vary from test to test by viewing a "bare" area of the photoconductor. The fact that the reference voltage is sensed each time a test is made by the same photodetector used to sense the developed image provides an extremely important advantage in that the variables associated with temperature, such as the effect of shifts in the magnitude of the dark current of the photodetector and shifts in the light output from the light source, are minimized. Other factors such as changes in the optical characteristics of the photoconductor due to oxidation and surface changes are also minimized. As a consequence of this dynamism the system becomes insensitive to temperature, becomes insensitive to variations in component qualities, and insensitive to other variables as noted. In the systems described in the prior art, few of these variables were ever compensated, most of them were not even considered.

Moreover, as taught and claimed in U.S. patent application Ser. No. 894,957; referenced above, by sensing the reference voltage during a test cycle from a bare photoconductor area that is used for the production of copies, additional quality-sensing capabilities are provided such as the sensing of an abnormally low reflectance photoconductor, i.e., a photoconductor on which toner buildup has produced a darkened condition or where the cleaning station or the erase means has malfunctioned such that an area of the photoconductor that should be clear is instead producing low reflectance.

Still another capability of the test apparatus is the means to partially check itself for proper functioning during periods when it is not in use. Therefore, when its use is needed, the machine is at least partially assured that it will receive correct indications of the measured qualities. This feature is taught and claimed in U.S. patent application Ser. No. 894,957.

SUMMARY OF THE INVENTION

This invention is incorporated into an electrophotographic machine and involves the use of a dynamically sensed and dynamically varying reference signal for use in quality tests such as toner density. Such a reference signal can be compared to a sensed developed image signal in order to provide a measure of developed image quality independent of temperature and other elemental sensitivities. The invention utilizes a single light source which is energized at different current levels designed to produce equal excitation of the single reflectivity-sensing device whether it is sensing the reference level or sensing the correct quality level. Thus, when the quality level is incorrect an unbalanced current level will result that is independent of photodetector and other circuit non-linearities.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION a. In General

Figure 1:
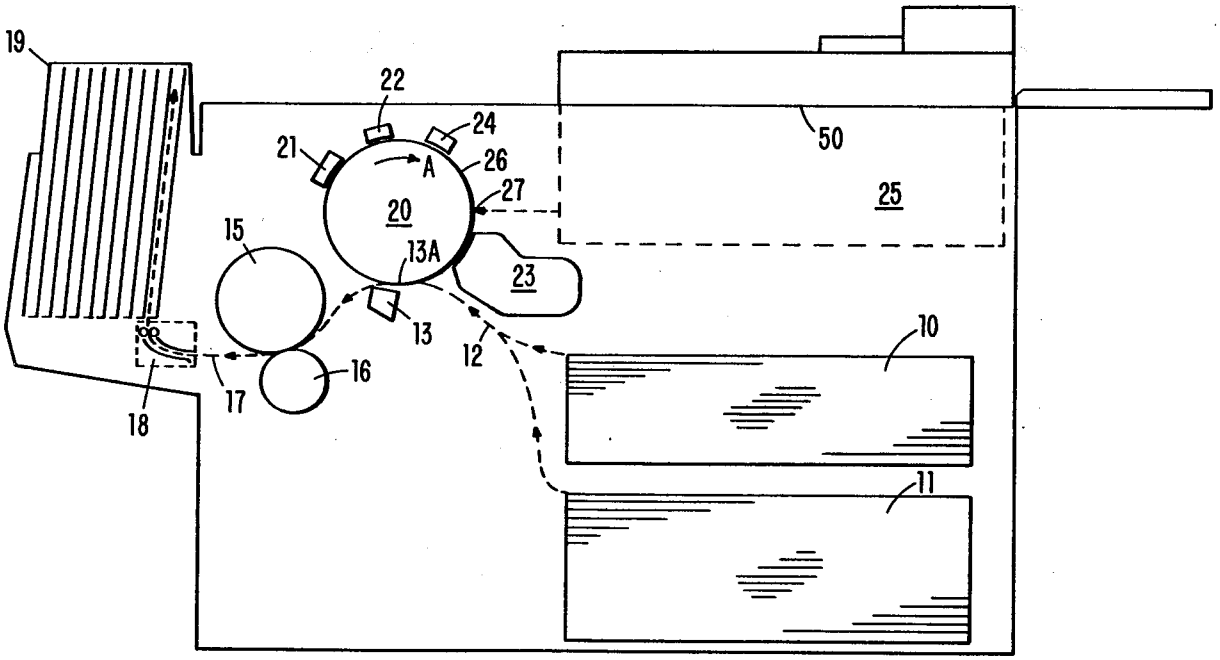
FIG. 1 shows a schematic layout of an electrophotographic machine utilizing the instant invention.

FIG. 1 shows a typical electrophotographic machine of the transfer type. Copy paper is fed from either paper bin 10 or paper bin 11 along guides 12 in the paper path to a transfer station 13A located just above transfer corona 13. At that station an image is placed upon the copy paper. The copy paper continues through the fusing rolls 15 and 16 where the image is firmly attached to the copy paper. The paper continues along path 17 into a movable deflector 18 and from there into one of the collator bins 19.

In order to produce an image on the photoconductive surface 26 a document to be copied is placed upon a glass platen 50. An image of that document is transferred to the photoconductive surface 26 through an optics module 25 producing that image on the photoconductive surface 26 at exposure station 27. As the drum 20 continues to rotate in the direction A developer 23 develops the image which is then transferred to the copy paper. As the photoconductor continues to rotate it comes under the influence of preclean corona 22 and erase lamp 24 which discharge all of the remaining charged areas on the photoconductor. The photoconductor continues to pass around and through the developing station 23 (which is also a cleaning station in this embodiment) until it reaches the charge corona 21 where the photoconductor 26 is again charged prior to receiving another image at exposure station 27.

Figure 2:
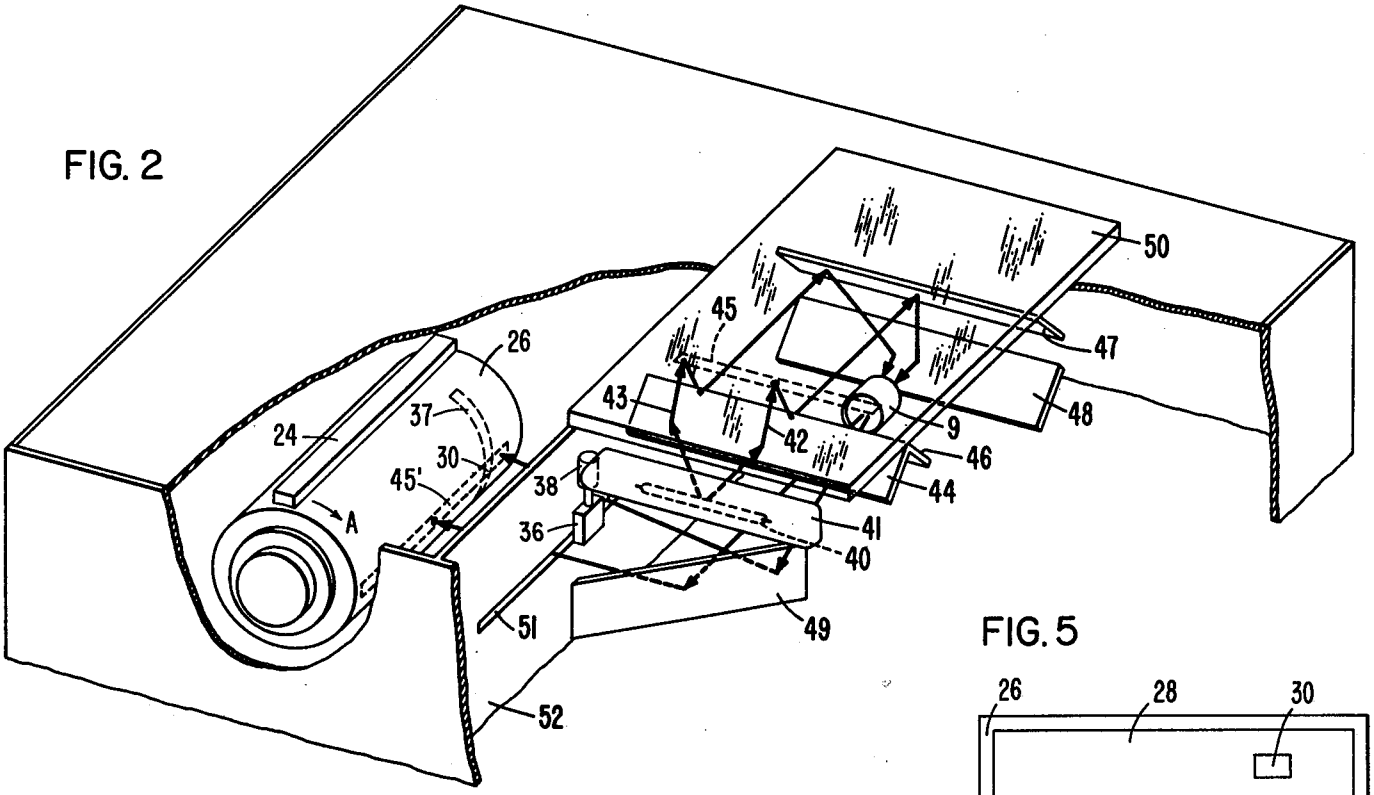
FIG. 2 shows the optical system and a photoconductive drum in the machine of FIG. 1.

FIG. 2 is a perspective of the optics system showing the document glass 50 upon which the document to be copied is placed. An illumination lamp 40 is housed in a reflector 41. Sample light rays 42 and 43 emanate from lamp 40 and are directed from dichroic mirror 44 to the document glass 50 whereat a line of light 45 is produced. Sample light rays 42 and 43 are reflected from the document placed on the document glass to reflective surface 46; from there to reflective surface 47 to reflective surface 48 and thence through lens 9 to another reflective surface 49. From mirror 49 the light rays are finally reflected through opening 51 in wall 52 to reach photoconductor 26 whereat a line of light 45' is produced. In that manner a replica of the information contained in the line of light 45 on the glass platen 50 is produced on the photoconductor 26 at 45'. The entire length of a document placed on document glass 50 is scanned by motion of lamp 40 and the mirrors 44, 46, 47 and 48. By traversing the line of light 45 across the document at the same speed at which the line of light 45' is moved across photoconductor 26 by rotation of drum 20, a 1:1 copy of the document can be produced on the photoconductor 26.

Figures 3, 4:
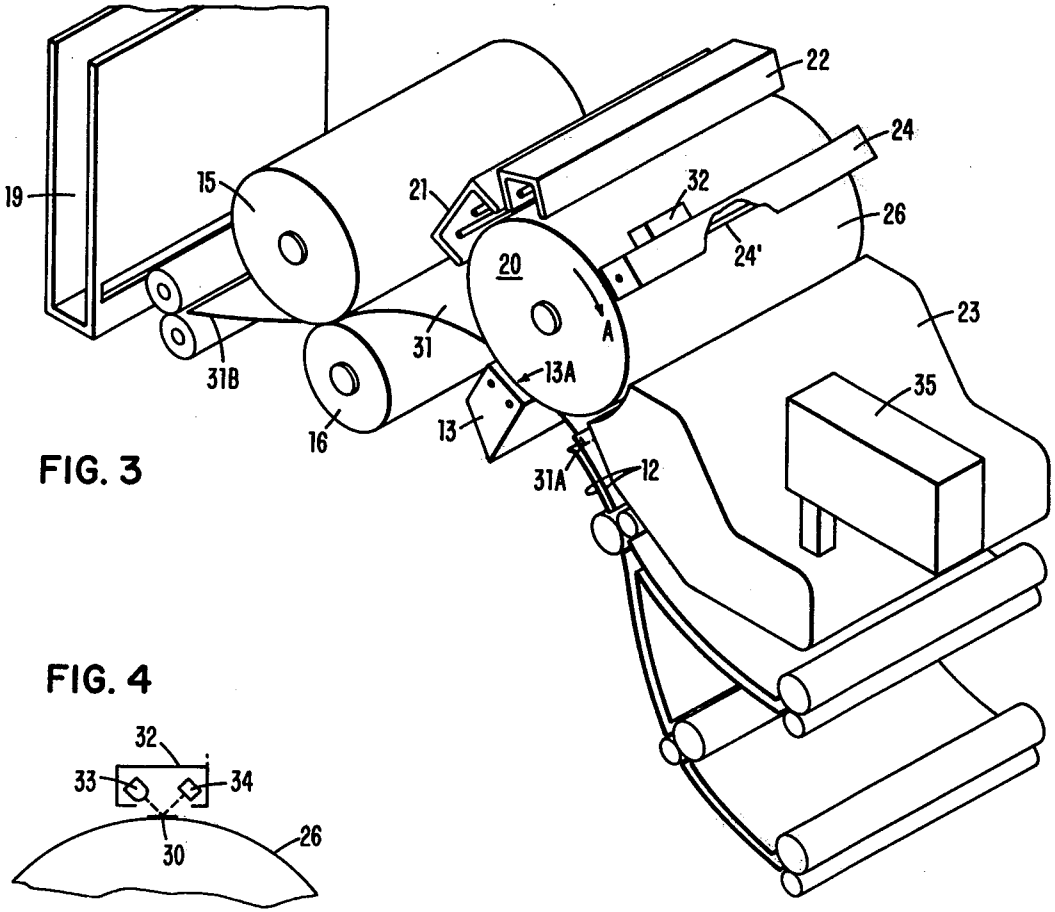
FIG. 3 is an idealized perspective view of components in the paper path of the machine.
FIG. 4 shows the reflectivity sensing elements of the toner concentration control device.

FIG. 3 shows the various elements in the paper path in perspective. Here a copy sheet 31 is shown with its trailing edge 31A in the paper path at guides 12. The copy paper is receiving an image at transfer station 13A and is in the process of having that image fused to itself by fuser rolls 15 and 16. The leading edge 31B of the copy paper is about to leave the document copier and proceed into the collator 19 which is represented in simplified form.

After an image is transferred to the copy paper, the photoconductor 26 continues to rotate until it comes under the influence of preclean corona 22 which applies a charge to the photoconductive surface to neutralize the remaining charge thereon. Photoconductor 26 continues to rotate until the photoconductor comes under the influence of an erase light 24' in housing 24. The erase light produces illumination across the entirety of the photoconductor 26 in order to complete the discharge of any remaining areas on the photoconductive surface which have not been neutralized by the preclean corona 22. After passing under erase lamp 24', the photoconductor continues through the cleaning station of developer/cleaner 23, wherein any remaining toner powder not transferred to copy paper is cleaned from the photoconductor prior to the beginning of the next copy cycle.

In the next copy cycle the charge corona 21 lays down a uniform charge across photoconductor 26 which charge is variably removed when the image of the document is placed on the photoconductor at the exposure station 27 shown in FIG. 1. Preclean corona 22 and erase lamp 24' are off during this cycle.

When the toner concentration control cycle is run, and if the result indicates a need to add toner to the developer, a signal is sent to replenisher 35 which holds a supply of toner and operates to dump a measured amount into the developer. In that manner, the toner density of the developer mix is replenished. Any suitable replenisher mechanism may be used including the replenisher described in *IBM Technical Disclosure Bulletin,* Vol. 17, No. 12, pp. 3516, 3517.

b. The Test Cycle

Figure 6:
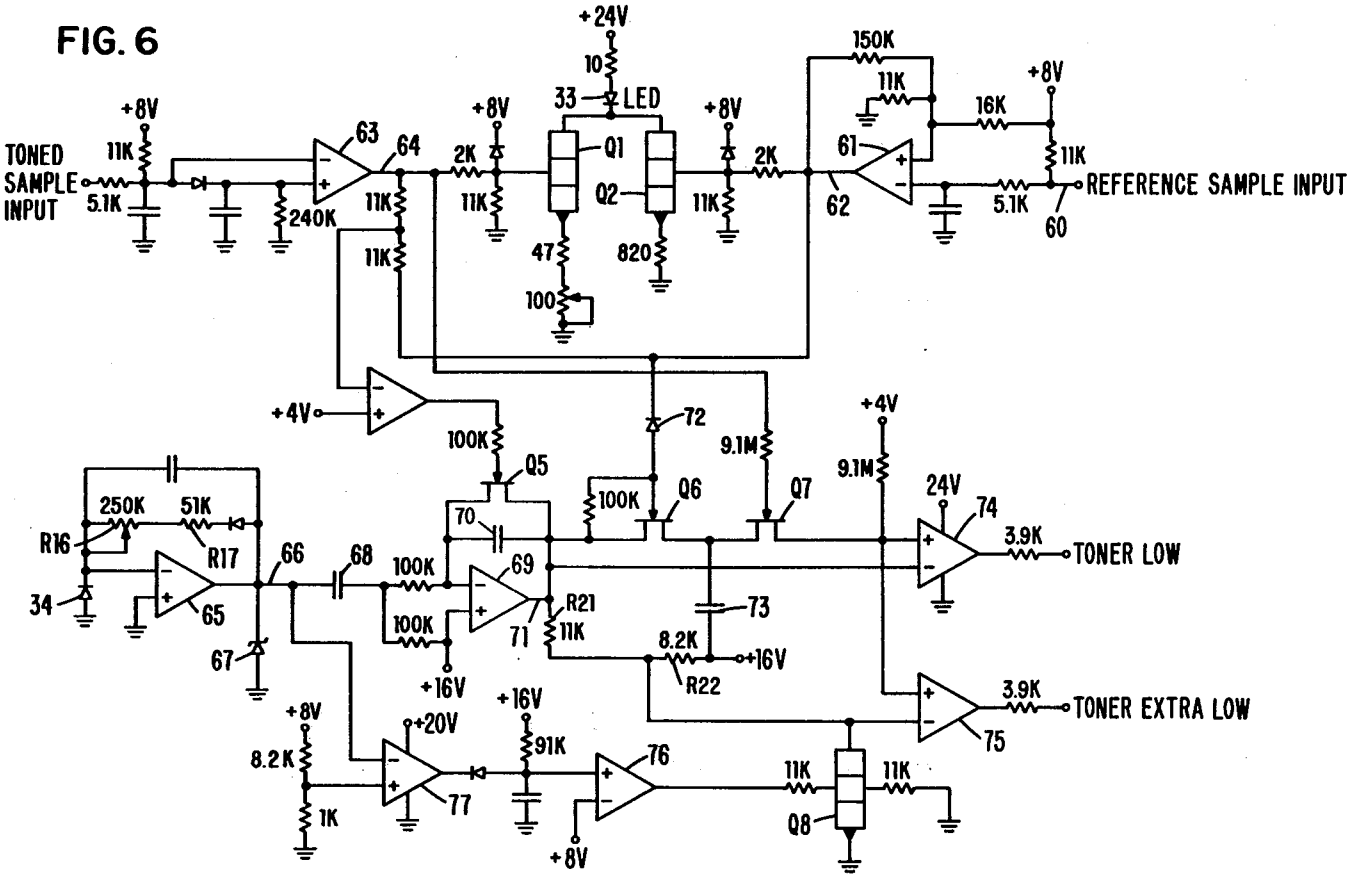
FIG. 6 shows the circuit for processing the reference and test information.

FIG. 3 shows a housing 32 containing the toner concentration control sensing system shown in FIGS. 4 and 6. When it is desired to sense for the concentration of toner in the developer mix the photoconductor is charged as usual at the charge corona 21, but no image is placed on the charged photoconductor at exposure station 27. Instead, on this cycle, the erase lamp 24' remains on discharging all of the charge which has been laid down by charge corona 21 in order to provide bare photoconductor for a reference test area. However, the erase lamp 24' is momentarily interrupted to produce a charged stripe toned sample for a test area. If the lamp 24' is comprised of an array of light-emitting diodes, the array can be segmented such that only a few of the LEDs are momentarily turned off and therefore only a small "patch" of charge remains on the photoconductor at the conclusion of this part of the cycle. If a fluorescent tube is used as the erase lamp 24', momentarily reducing its energization to a low level will produce a "stripe" of charge remaining on the photoconductor at the conclusion of this part of the cycle.

Whether a stripe of charge or a patch of charge is produced, the charged test area continues to rotate in the direction A until it reaches the developer 23 where toner is placed onto the charged area to produce a toned sample test area. No copy paper is present at transfer station 13A in the test cycle, thus allowing the developed test area to continue its rotation in direction A until it approaches the toner concentration control housing 32. At this point, referring now to FIG. 4, a light-emitting diode (LED) or other suitable light source 33 is energized to produce light rays which reflect off the toned sample test area 30 and are reflected to a photosensor 34. It should be noted that the toned image could be transferred to copy paper, if desired. The reflectance of the developed and transferred stripe (or patch) would then be sensed by locating sensors on the paper path. It should also be noted that the principles of this system work well with photosensitive paper, i.e., electrophotographic machines in which the image is exposed directly onto the copy paper rather than through a transfer station.

Figure 5:
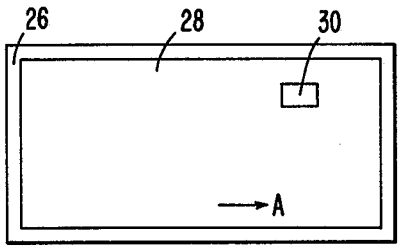
FIG. 5 shows the layout of the photoconductor with the location of the bare reference area and the developed test area within the document reproduction image area.

FIG. 5 shows the layout of the photoconductor 26 with an image area 28 outlined therein. A developed patch 30 has been produced within the image area 28. FIG. 2 shows apparatus for producing patch 30. As described above, erase lamp 24' is momentarily interrupted to produce a stripe of charge. While the above description designated 45' as a line of light producing an image on photoconductor 26, suppose now that during the test cycle the line or stripe 45' is used to designate a stripe of charge produced by momentarily interrupting lamp 24'. Suppose also that document lamp 40 is turned on during the test cycle so that light from lamp 40 will erase the stripe of charge 45' unless it is interrupted. Such an interruption is made possible by the provision of shutter 36 which is shown in FIG. 2 as dropping across slot 51 in wall 52. Shutter 36 is actuated by solenoid 38. As a result, light from lamp 40 is blocked away from photoconductor 26 by shutter 36, thus producing a stripe of charge 37. Of course, erase lamp 24' will erase all of stripe 37 except for patch 30. In that manner, a patch instead of a stripe can be produced. Note that slot 51 should be positioned close to the photoconductive surface 26.

c. The Circuit—FIG. 6

In order to produce a reference voltage, when the proper time in the sequential operation of the machine has arrived, the logic control of the machine provides a signal to trigger the viewing of a reference sample. This is accomplished by energizing LED 33 in the following manner. The logic signal results in triggering a transistor switch (not shown) which connects the reference sample input line 60 to ground. As a consequence, the voltage on the negative input of OP AMP 61 is dropped from approximately 8 volts to about ground potential.

This causes the negative input of OP AMP 61 to switch from a value higher than the positive input to one that is lower resulting in an inversion of OP AMP output from low to high on line 62. That output is then fed back to the positive input to lock the OP AMP 61 in a high output condition avoiding oscillations. The output voltage on line 62 is applied to transistor Q2 to turn that transistor on, thus closing a circuit from the 24-volt source through the light-emitting diode 33 and transistor Q2 to ground. The result is to provide light from the LED 33 to the photocell 34 at the precise time in the machine cycle to reflect light rays from the bare photoconductor to photocell 34.

In order to produce a sensed toned sample voltage, when the proper time in the machine cycle is reached to direct light upon the toned sample a logic signal is provided to turn on a transistor switch, not shown, to connect the toned sample input line to ground. This results in lowering the negative input on OP AMP 63 from approximately 8 volts to ground potential and causes the output on line 64 to go high. The signal on line 64 turns on the transistor Q1, causing the light-emitting diode to conduct through the transistor Q1 to ground. Note that the resistance levels connected with the transistor Q1 are significantly lower than the resistances associated with transistor Q2. As a result, the current level through transistor Q1 is significantly higher than the current level through Q2, thus creating a more intense light from LED 33 when the toned sample is viewed. The reason for this is that the bare photoconductor will reflect a higher light level than the toned photoconductor. It was recognized that the reflected light intensities exciting the photocell must be kept at a nearly equal level whether viewing a bare sample or a toned sample. The reason for this is to avoid the nonlinearities which occur in photocell excitations from reception of different light levels to avoid the nonlinearities in circuit response and to guarantee high signal levels whether viewing the bright reference sample or the dark toned sample in order to improve noise immunity. In a system which should be relatively free from variations in component sensitivities, this is an important feature.

Referring now to the circuit of photocell 34, note that OP AMP 65 is connected as a transconductance amplifier. With photocell 34 off only a small dark current flow exists between the output of OP AMP 65 and the negative input. However, when the photocell is excited, the current flow is substantially increased causing a significant voltage drop across resistors R16 and R17 creating a voltage level at line 66 of perhaps 1 or 2 volts. Zener diode 67 limits the voltage level which can occur at line 66 to 8.5 volts, i.e., a swing of 8.5 volts from the photocell unexcited value. Assuming a photocell excited voltage level of 2 volts at line 66, the change from 0 volts to 2 volts is coupled through capacitor 68 to an integrating circuit comprised of OP AMP 69, capacitor 70, field effect transistor (FET) Q5 and the associated resistances. Under standby conditions 16 volts is placed on the input of OP AMP 69 resulting in an output of 16 volts at line 71. When a light source excites the photocell, resulting in a voltage of, for example, 2 volts on line 66, the two-volt swing is coupled by capacitors 68 and 70 to line 71, resulting in a ramping down of the voltage on line 71 from 16 volts to 14 volts. If a bare (reference) sample is being taken the output of OP AMP 61 biases diode 72 to turn on FET Q6 during the bare sample period. Thus the 14 volts on line 71 passes through FET Q6 and is placed on capacitor 73. That voltage is stored until such time as the toned sample is taken by photocell 34.

When the toned sample is taken, there should again be a 2-volt potential produced on line 66 if the density of the toned sample is approximately correct. This is true because of the balancing of current flow in photocell 34 regardless of whether a reference sample or a toned sample is being taken (due to the different current levels through LED 33 as explained above). Thus a 2-volt swing on line 66 is coupled by capacitors 68 and 70 to line 71, causing the voltage of line 71 to ramp down from 16 to 14 volts. During the toned sample input period FET Q7 is turned on and FET Q6 remains off. Thus the 14 volts present on capacitor 73, that is, the reference voltage, is placed on the positive inputs of OP AMPS 74 and 75, while the toned sample input present on line 71 is connected directly to the negative input of OP AMP 74, and is connected through a voltage divider network to the negative input of OP AMP 75. If, for example, resistance levels R21 and R22 were equal, the potential at the negative input of OP AMP 75 would be the difference of 14 volts on line 71 and the 16 volts input, that is, 15 volts.

At OP AMP 74, the 14-volt reference signal is placed on the positive input while the 14-volt toned sample signal is placed on the negative input. Since there is no differential, the output of OP AMP 74 indicates that the toner concentration condition is correct and the toner low signal remains off. Similarly, at OP AMP 75, the bare sample input is 14 volts, the toned sample input is 15 volts, and therefore the toner extra low signal remains off.

Suppose, however, that the toner density of the toned patch was too light. The result would be an excessive reflection of light from that patch, causing a high excitation of photocell 34 and resulting in a potential at line 66 of, for example, 4 volts. In this example a 4-volt swing would be coupled by capacitor 68 to line 71, thus causing a ramping of the voltage at line 71 from 16 volts to 12 volts. Now the 12 volts appear directly on the negative input of OP AMP 74 and is compared to the 14 volts on the positive input, creating a high output, thus turning on the "toner low" signal. OP AMP 74 is designed to register when a 30 millivolt difference appears, and thus the low output signal will now be energized. At OP AMP 75, the toned sample signal of 12 volts on line 71 is divided against 16 volts and if the resistances R21 and R22 were equal, would cause 14 volts to appear at the negative input of OP AMP 75. Since both inputs are 14 volts, the toner extra low signal remains off.

Suppose now that the toned sample was so light that the photocell excited to such a degree that a 6-volt swing was experienced on line 66, thus sending the voltage on line 66 from 0 volts to 6 volts. That 6-volt swing causes a ramping of the voltage on line 71 from 16 volts to 10 volts. When the 10 volts is divided with the 16 volts (again assuming equal R21 and R22 values) a voltage of 13 volts is placed on the negative input of OP AMP 75. When this 13-volt signal is compared to the 14-volt reference, the toner extra low output signal is turned on.

During regular operation of the machine, i.e., when there is no interruption for a test cycle, it is desirable to provide a checking signal in order to determine that the test network is in operating order. That is provided by the portion of the circuit including transistor Q8. Note that when transistor Q8 is turned on the negative input to OP AMP 75 is grounded and thus turns high the output of OP AMP 75. As a consequence, the toner extra low signal is turned on. At the same time the voltage levels at OP AMP 74 keep the toner low output signal off. This creates an unusual condition of having the toner extra low signal on while the toner low signal is off. This condition is forced by the operation of transistor Q8, and thus any change in this condition during the operation of the machine will signify to the machine logic that something is wrong in the test circuit. Note that transistor Q8 is turned on by a high output from OP AMP 76. A high output from OP AMP 76 is present whenever the output of OP AMP 77 is high (neglecting the RC time delay). OP AMP 77 is high when the negative input is lower than the input on the positive side. Note that since line 66 is at 0 volts during regular operation, the voltage at the negative input of OP AMP 77 is lower than the positive side under normal conditions. Note, however, that when a bare or toned sample is taken, voltage on line 66 rises thus turning off the high output from OP AMP 77, turning off the high output from OP AMP 76 and thus opening the circuit of transistor Q8.

Another quality test available through this circuit is that if the photoconductor has become so coated with toner that when the bare sample is taken it actually is a darkened sample, there will be only a small amount of light from LED 33 appearing at the photocell 34. It will be a much lower photocell excitation than expected, consequently, the voltage on line 66 does not change significantly, and thus even though a bare sample is being taken, transistor Q8 is not turned off since line 66 does not change significantly higher from its regular value. Therefore the output of OP AMP 77 remains high and transistor Q8 remains on. In this situation, the logic senses the fact that the toner extra low output signal from OP AMP 75 has remained on even though it should have gone off when entering the test sequence. This informs the logic that a darkened photoconductor condition is present and that remedial steps are needed. Consequently, the circuit of transistor Q8 performs a darkened photoconductor check as well as indicating the presence of problems in the test circuit itself.

Upon testing for toner density, if the toner low signal is activated, the toner replenisher 35 (FIG. 3) operates to dump a quantity of toner into developer 23. If both the toner low and the toner extra low signals are activated, a variety of possibilities for further action are present, depending on machine design. For example, the first subsequent action would probably be to check a "cartridge empty" signal from the toner replenisher 35. If it is empty, a call for the key operator of the machine is in order. However, if the replenisher has an adequate toner supply, the next action might be to shut the machine down. Alternatively, there might be repeated toner density checks after a few more copies until the toner extra low signal is no longer active. At some point, if the extra low signal remains activated, the machine would be shut down.

As stated above, a test cycle can be run on the shutdown cycle when only small numbers of reproductions are called for during a reproduction run. Special test cycles with reproductions skipped may be used only during long, multi-copy runs. Providing the specific control circuitry for interrupting machine operation to provide special test cycles at the proper time is dependent upon the requirements of a particular machine. Such circuit design is well within the skill of the art and does not comprise a part of the instant invention. Similarly, control apparatus for receiving the forced condition signal and the toner low and toner extra low signals to actuate the replenisher as well within the skill of the art and not a part of the invention herein.

While this invention has been described within the framework of a particular embodiment, i.e., a transfer type machine of the two-cycle type, it can be equally well used in conventional single-cycle machines and it will be understood by those skilled in the art that the foregoing and other changes in form and details may be made without departing from the spirit and scope of the invention.

What is claimed is:

1. A method for checking quality variables in an electrophotographic reproducing machine including the steps of:

(1) adjusting the value of a sensed reference signal and the value of a sensed sample signal to be approximately equal for correct quality condition;

(2) using an illumination-sensing means to produce said sensed reference signal and said sensed sample signal, both of said signals thereby representing variable conditions within said machine;

(3) comparing said reference signal and said sample signal to obtain a ratio of the reference and sample signals to produce an output signal indicative of the quality variable; and (4) repeating steps 2–3 each time a quality check is made, whereby variable conditions within said machine and within the components of the checking apparatus appear within the sensed reference signal and the sensed sample signal in relatively equal proportions, thus producing an output signal which varies only with quality.

2. The method of claim 1 wherein said step of adjusting involves an adjustment of the illumination output of light source means used as the source of illumination for exciting said sensing means so that said light source means produces a first intensity output when the reference signal is produced and a second intensity output when the sample signal is produced so that said reference signal and said sample signal may be equalized.

3. The method of claim 2 wherein said reference signal and said sample signal are obtained by sensing illumination reflected from the area of the photoconductive surface used at other times for producing document images.

4. In an electrophotographic copier machine wherein images of documents to be copied are produced on photoreceptive material, said machine including a developer to apply toner to said images, light reflectance sensing means to view said photoreceptive material, a quality checking method including the steps of:

(1) producing a charged test area and a discharged reference test area on said photoreceptive material;

(2) developing said charged test area;

(3) using an illumination-sensing means to measure the reflectivity of said discharged reference test area to establish a reference signal indicative of clean photoconductor;

(4) using the identical sensing means to measure the reflectivity of the developed test area to establish a sample signal indicative of the quality of a toned image;

(5) comparing said reference signal to said sample signal to thereby provide an output signal indicative of quality;

(6) adjusting the value of said reference and sample signals until said output signal is approximately zero for correct quality conditions; and (7) repeating steps 1–6 each time a quality check is made.

5. The method of claim 4 wherein said reference test area and said developed test area are located within the area of the photoreceptive material used for document reproduction.

6. The method of claim 4 wherein said step of adjusting involves an adjustment of the illumination output of light source means used as the source of illumination for the reflectivity measurements so that said light source means produces a higher intensity output when the toned sample signal measurement is produced and a lower intensity output when the reference signal measurement is produced.

7. Quality control test apparatus for an electrophotographic machine comprising:

a photoconductive material;

charge corona means for charging said photoconductive material;

erase means for discharging a portion of said photoconductive material to establish a discharged test area and a charged test area for a toned sample;

developing means for placing toner on said charged test area to provide said toned sample;

single light-sensitive means for receiving light rays reflected from said discharged test area to establish a reference signal indicative of the light reflecting capability of clean photoconductive material, and for receiving light rays reflected from said toned sample to establish a signal indicative of the light reflecting capability of the developed test area;

comparator means for comparing the sensed reference signal and the sensed toned sample signal to establish an output signal indicative of quality; and adjusting means for adjusting the sensed reference signal and the sensed toned sample signal to approximately equal each other when the quality level is correct.

8. The test apparatus of claim 7 wherein said adjusting means includes a light source energized to produce a relatively low level of light for sensing the reference signal and a relatively high level of light for sensing the toned sample signal.

9. The test apparatus of claim 8 wherein said charged test area and said discharged test area are located within the area of the photoconductive material used for document reproduction.

* * * * *